428-408
3/24/81 XR 4,257,157

United States Patent [19]

Pollock et al.

[11] 4,257,157

[45] Mar. 24, 1981

[54] POROUS ELECTRICAL RESISTANCE HEATERS

[75] Inventors: James F. Pollock, Hook, England; Keith R. Linger, Sarnia, Canada; Vincent K. Hewinson, Wyberton, England

[73] Assignee: United Kingdom Atomic Energy Authority, London, England

[21] Appl. No.: 908,681

[22] Filed: May 23, 1978

[30] Foreign Application Priority Data

May 23, 1977 [GB] United Kingdom ..... 21702/77

[51] Int. Cl.[3] ..... H05B 3/14

[52] U.S. Cl. ..... 29/611; 219/381; 264/29.1; 338/225; 338/334; 428/368; 428/408

[58] Field of Search ..... 29/611, 610 R; 219/381; 338/225, 211, 212, 258, 334; 264/29.1; 428/368, 408, 272, 367

[56] References Cited

U.S. PATENT DOCUMENTS

| | | | |
|---|---|---|---|
| 3,869,242 | 3/1975 | Schladitz | 219/381 |
| 4,112,059 | 9/1978 | DiEdwardo | 264/29.2 |

FOREIGN PATENT DOCUMENTS

| | | | |
|---|---|---|---|
| 993498 | 5/1965 | United Kingdom . | |
| 1096375 | 12/1967 | United Kingdom | 219/381 |
| 1182421 | 2/1970 | United Kingdom | 219/381 |
| 1283352 | 7/1972 | United Kingdom | 219/381 |
| 1444461 | 7/1976 | United Kingdom | 219/381 |
| 1466240 | 3/1977 | United Kingdom | 219/381 |
| 1503644 | 3/1978 | United Kingdom . | |

*Primary Examiner*—Francis S. Husar
*Assistant Examiner*—Gene P. Crosby
*Attorney, Agent, or Firm*—Larson, Taylor and Hinds

[57] ABSTRACT

A method of manufacturing a fluid permeable electrical resistance heater element having a structure that promotes uniformity of flow of fluid through the element and a uniformity of heating throughout the element. The method comprises forming a fluid permeable body of unbonded carbonizable fibres. A latent solvent is applied to the fibres and the solvent is subsequently caused to dissolve at least a surface of the fibres so as to effect bonding of the fibres together. The carbonizable fibres are subsequently carbonized to produce a fluid permeable carbon body.

15 Claims, 3 Drawing Figures

POROUS ELECTRICAL RESISTANCE HEATERS

This invention relates to fluid permable electrical resistance heater elements and to a method of manufacturing such heater elements.

Fluid heating systems, in which heat is generated by the Joule heating effect resulting from the passage of an electric current through a fluid permeable electrically conductive structure, and transferred to a fluid permeating through the structure are well known. One such system is described in British Pat. No. 1,182,421. Such fluid heating systems offer a number of advantages and in particular provide a compact heating system by virtue of the large internal surface which is available for heat transfer.

In the design of fluid permeable electrical resistance heating elements for specific purposes there are several important considerations, namely:

(a) The uniformity of flow of the fluid passing through the heating element;

(b) The heat generation and heat transfer characteristics of the permeable resistance heating element in relation to the type of fluid to be heated and the conditions, e.g. pressure, temperature, fluid flow rate and transit time through the element, under which heat transfer should take place;

(c) The specific electrical resistance of the element structure in relation to the preferred element geometry and the electrical power supply phase, voltage and current required to generate heat at a particular rate. The element must therefore be designed taking a number of considerations into account.

The uniformity of heat generation throughout the element is determined mainly by the internal structure of the element. The material from which the element is made together with the internal and external geometry of the element define its resistance and hence the voltage-current characteristics of the power supply needed to generate heat at a given rate.

For uniform heat generation in the heating element one requirement is for there to be little macroscopic variation of material density and resistivity as possible, since this variation causes electrical resistivity, and therefore heat generation in the element, to vary from region to region. Some variation must, and obviously can, be tolerated provided that the variation is not large and occurs over small distances and that preferably such variations are uniformly distributed and not locally concentrated.

Certain types of permeable structures are better than others for uniformity of heat generation. A heater comprising substantially granular particules of an irregular spherical nature consists of an assembly of particles bonded or fused at low area contact points which are relatively high resistance regions. This type of structure is predisposed towards hot-spot formation since most of the heat is generated at these contact points and must be transferred to other regions of the granules before the fullest use can be made of the available surface area for transfer of heat to the fluid. Consequently local temperature gradients are encouraged and if there is even a slight degree of local flow non-uniformity due to porosity or pore size differences, or other factors, hot-spots will develop. Where the heating element material has a negative temperature coefficient of resistance, a tendency to hot-spot formation may be accentuated. If a granular structure is then to be used, special precautions must be taken during manufacture of the heater body to ensure uniform packing of the granules and consequently adequate uniformity of voidage pore size and heat generation.

Granular type structures also have certain limitations regarding the degree of internal voidage which can be attained. This arises as a result of the packing characteristics of the individual grains. Thus, for example, it would be very difficult to manufacture a permeable heating element having both a very high voidage, e.g. greater than 75%, and a small pore size, e.g. less than 200 microns, using granular type material for construction. This consequently limits the extent to which stored heat in the element material can be reduced and thus prevents a very rapid response to changes in the heat generation requirements.

Many of the problems which have been described can be largely overcome by the use of fibres instead of granules in forming the body of the element. In particular fibres allow the formation of high voidage low density structures and fibre to fibre contacts can be formed which considerably reduce the disparity in resistance in comparison with that which exists in granular structures between resistance at the contact points and within the granules themselves.

A fibrous structure has also been found to be particularly advantageous for the heating element from the heat generation and heat transfer aspect, since it provides a very high internal surface area for heat transfer, e.g. 1–100 $m^2/cm^3$.

Techniques for manufacture of fibrous heater elements include the carbonisation of natural or synthetic fibres which have been processed into a matrix of suitable permeability and pore size.

The effectiveness of a permeable heater element depends to a considerable extent on the ability to manufacture a structure of a geometry which is not only suitable for the fluid flow and heat transfer conditions but which will allow the desired power rating to be obtained at a selected supply voltage, which may be mains voltage. This is sometimes very difficult to achieve especially in fibrous carbon structures since it implies close control of fibre distribution and density and fibre to fibre bonding to achieve a continuous conducting matrix of the correct electrical resistance in relation to the element geometry and the desired power rating.

The shape and dimensions of the heater element can, to a certain extent, be chosen so as to produce a heater element having the desired heat transfer characteristics. However, the power supply/voltage considerations may impose certain restrictions on the size and shape of the heater element.

Fibrous carbon heating elements have been developed are described for example in British Pat. Nos. 1,096,375 and 1,444,461. The technique described in Pat. No. 1,096,375 does not include provision for effecting fibre to fibre bonds so that the contact points are essentially touching contacts and therefore of high local resistance. This is a disadvantage and can lead to hot-spot formation and arcing. The techniques discussed in Pat. No. 1,444,461 requires the use of a method such as needling to compact the fibre batt and produce sufficient strength for cylindrical elements to be formed on a mandrel by a tension winding procedure. Thus needling introduces local non-uniformities in the element material which can result in local overheating in the eventual heating element. Additionally the compacted fibre batt produces a layering effect and different stress and strain effects in the cylindrical body due to the tensioning during winding. Furthermore the fibre to fibre contacts are formed by means of a carbon coating deposited on the fibres either by a process of impregnation of the permeable body with a carbonisable resin or by decomposition of a hydrocarbon on the fibres. The carbon coating is not always uniformly distributed throughout the body and this can lead to non-uniform power generation.

A method has now been developed by which these limitations can be overcome and which allows the manufacture of high performance elements which can operate at a power density of 1 $Kw/cm^3$ of element volume.

According to one aspect of the present invention there is provided a fluid permeable electrical resistance heater element comprising an assembly of carbonised fibres in a random disposition wherein fibre to fibre joining at the points of contact of the fibres is effected before carbonisation of the fibres, the joining being effected by fusing touching fibres together by applying a latent solvent, which is latent during the process by which the shape density and final structure of the element are largely determined and activating the solvent prior to carbonising the fibres.

According to another aspect of the present invention there is provided a method of manufacturing a fluid permeable electrical resistance heater element comprising the steps of: forming a web or batt of carbonisable fibres; applying to the fibres a latent solvent for the fibres; forming the web or batt into a body of preferred geometry and density; activating the solvent thereby to effect bonding of the carbonisable fibres together and carbonising the body of bonded fibres.

The term "carbonised fibres" as used herein shall be taken to refer to carbon fibres which may or may not have been subsequently graphitised.

The term "latent solvent" as used in this specification is taken to mean a substance which when applied to the carbonisable fibres does not, in predetermined ambient conditions around the fibres and substance, dissolve the fibres, but which can be caused to have a solvent effect on the fibres by varying the ambient conditions.

The terms "activated" and "activating" as used in this specification, shall be taken to refer to the effect on the latent solvent of changing the ambient conditions around the fibres and latent solvent thereby to cause it to have a solvent effect on the fibres.

The latent solvent for the fibres, is applied to the fibres either before the fibres are formed into the body, the bonds being formed before or after the fibres are formed into the body but before carbonisation, or after the fibres are formed into the fluid permeable body. In both cases the latent solvent is activated after the fibres are formed into the body.

According to another aspect of the present invention there is provided a fluid permeable electrical resistance heater made by the above method.

The preferred method of manufacturing the heater element comprises the steps of: producing carbonisable fibres which have a diameter of 5 to 200 microns and staple lengths in the range of 1 to 250 mm; forming the fibres into a fluid permeable body having a mean density of 10 to 250 $kg/m^3$ and a voidage in the range of 75 to 99%; applying to the fibres a latent solvent for the fibres; activating the solvent thereby to effect bonding of the carbonisable fibres together; heating the body in an oxidising environment to a temperature of 140° to 300° C. at the rate of temperature rise of between 0.001° to 10° C. per minute to produce an oxidised body having a density in the range of 15 to 400 $Kg/m^3$; and heating the oxidised body to a temperature of 700° to 3000° C. at the rate of temperature rise of 0.5° to 50° C. per minute in a substantially oxygen free environment to produce a carbonised body having a density up to 400 $Kg/m^3$ and a voidage in the range of 75 to 98%.

Preferably the step of forming the fibres into a fluid permeable body comprises the steps of forming a batt of fibres which has a weight per unit area of 10 to 500 $g/m^2$ and rolling the batt onto a mandrel while controlling the mean density of the rolled body by controlling the winding conditions applied to the batt.

Where the fibres are polyacrylonitrile (PAN) type fibres the latent solvent may be cyclic tetramethylene sulphone which is thermally activated by heating the fibres in air to a temperature of 110° to 150° C.

The following latent solvents may be suitable for use in the present invention when using PAN type fibres, namely propylene carbonate or di-substituted formamides such as for example bis-cyanoethyl formamide.

The latent solvent is advantageously applied to the fibres before they are formed into the body, for example before, during or after formation of the batt. Alternatively the solvent may be applied wholly after formation of the body or in part before and in part after formation of the body. The application of the latent solvent to the fibres before they are formed into the body has the advantage that substantially less latent solvent need be applied to produce a sufficient number of inter-fibre bonds than is required if the latent solvent is applied after formation of the body. Additionally the latent solvent is more evenly dispersed throughout the body.

The latent solvent may be dripped or sprayed onto the fibres, the fibres may be immersed in the latent solvent, or the latent solvent may be vapour deposited on the fibres.

The solvent may be activated after formation of the body or if applied to the batt, may be activated before or after formation of the batt and before the batt is rolled into the body.

The use of a latent solvent to provide the bonds between the fibres has the advantage that the resulting bonded body is homogeneous as regards material. Thus the final carbonised body will have a constant resistivity throughout which removes one cause of localised hot spot formation in the heating element. Additionally differential stresses in the body are reduced because of the existance of only one material throughout the body.

Embodiments of the invention will now be described by way of example only and with reference to the accompanying drawings in which.

Figure 1:
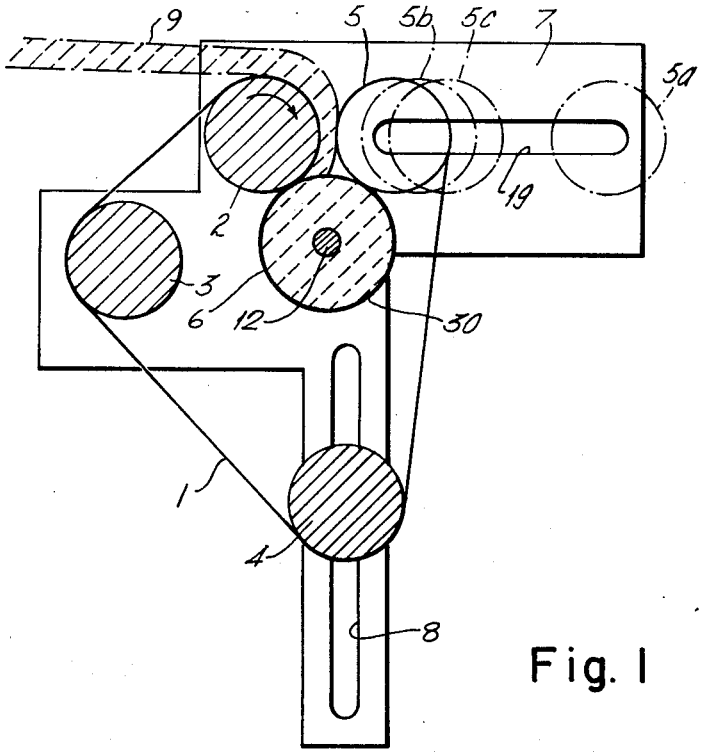
FIG. 1 shows a diagrammatic representation of apparatus for forming a batt into a hollow cylinder.

By use of the preferred method of manufacturing a heater element comprising a body of carbonised fibres, an element can be produced which not only has a sufficient degree of internal uniformity of fibre distribution and fibre to fibre bond distribution to allow heat to be generated by the passage of an electric current through the permeable body and to be transferred to the fluid flowing through the permeable body in a sufficiently uniform manner to avoid significant temperature differences in the fluid or variations in dryness fraction of the fluid leaving the body and provides sufficient fibre surface area for the heat transfer to the fluid to be effected without excessive temperature differences between fibre surface and fluid in contact with it, but also has the required electrical resistivity and mechanical strength for the body to be used as a permeable heater and to withstand the forces necessary to form pressure contacts at the electrodes.

The electrical and heat generation characteristics of a fibrous carbon body of given geometry depend initially on the choice of fibre type, distribution of density, denier, staple length, crimping and orientation in the precursor material, and on the extent and nature of the fibre to fibre bonds and the method by which the precursor materials are formed into the body. It is also influenced by the carbonisation or graphitisation conditions. There are various ways of forming the initial fibrous body into a suitable structure so as to exercise control over density, permeability, and uniformity of the structure and electrical resistance of the carbonised body, one of which will now be described.

Where more than one fibre type is used the fibres are blended to ensure that fibres of different types or parameters are thoroughly intermixed. Standard textile machinery is suitable for this purpose. While the fibres may be natural or synthetic or a mixture, the preferred fibres are polyacrylonitrile type fibres of 4.5 denier and 63 mm staple.

From the raw or blended fibre stock a single fine web of fibres is produced by a typical textile carding, garnett or air laying machine. The fibre staple direction is substantially in the plane of the web and in the general direction of the motion of the web leaving the machine. This web is fragile and may be collected in single ply on a wheel or cylinder or may be platted or cross-folded into a multi-ply batt of greater bulk and then collected in a similar way. It should be noted that platting superimposes parallel webs one above the other retaining the same fibre orientation as the original web whereas cross-folding the web changes the orientation of the fibre staple direction. Cross-folding requires the batt to be formed as a result of its movement at right angles to the web movement direction.

A latent solvent, e.g. of the type described in British Pat. No. 993,498 with PAN fibres, is applied during formation of the batt, and provides a wet uncompacted and unbonded web having sufficient strength to be handled. It is preferred to apply the latent solvent cyclic tetramethylene sulphone (Bondolene A or Sulpholane from Shell Chemicals Limited) to the fibres at a rate of 5 to 40%, preferably 12 to 35%, by weight of fibres.

Since the wet web is handleable, the bond formation can be postponed to the stage when the batt has been formed into the body of the desired shape. The latent solvent is then thermally activated as described in British Pat. No. 993,498. In an alternative procedure, the latent solvent is applied to the batt after it has been formed and before subsequent processing into the body. As a further alternative the latent solvent may be activated after the batt has been formed and before it is formed in the body.

The batt is fed into an apparatus as described in British Pat. No. 1,503,644, one form of the apparatus being shown by way of example in FIG. 1 to which reference is made. In FIG. 1, an endless belt 1 extends around four rollers 2, 3, 4 and 5, roller 5 also being shown in chain dotted outline in alternative positions designated by 5*a*, 5*b*, and 5*c* since it has a shaft (not shown) locatable in a slot 19 to allow the shaft and thus roller 5 to be moved to these positions. Rollers 3 to 5 are idler pulleys, roller 2 is driven in the direction of the arrow by a variable speed motor (not shown), and roller 4 is displaceable in a slot 8 under the action of a drive motor (not shown.) Between rollers 2 and 5, the belt 1 is shaped to form a loop 6 so as to form a hollow cylinder 30 of a batt 9 about a central mandrel 12 when the batt 9 is fed between the rollers 2 and 5. The diameter of the loop 6 is variable by the displacement of roller 4.

In use of the apparatus of FIG. 1, a relatively uniform compression is applied over virtually the whole of the circumference of the cylinder 30 by the belt 1, and the roller 4 is progressively moved along the slot 8 towards the mandrel 12 to increase the diameter of the loop 6 and thus of the cylinder 30. For further detailed information reference may be made to the aforesaid British Pat. No. 1,503,644.

In a particular embodiment a batt having a predetermined weight and length is fed into the apparatus of FIG. 1 in a pre-determined time, which is the time in which the belt loop 6 is constrained to change in size from that of the mandrel 12 to the selected final diameter of the cylinder 30. This facility ensures that a cylinder 30 of defined diameter and mean density is produced. To ensure simultaneously that the density distribution, both circumferentially and radially, shall be relatively uniform throughout the fibrous cylinder 30, the rate at which feeding proceeds is increased linearly by the ratio of the selected outside diameter of the cylinder 30 to that of the mandrel 12.

The procedure is to insert the mandrel 12 and drive the apparatus of FIG. 1 until the belt loop 6 conforms to it. The batt is then fed to the mandrel 12 and is rolled round it as the operation proceeds until the loop 6 size control section of the apparatus is automatically stopped when the required diameter has been achieved. This is facilitated by a pre-set micro-switch (not shown) which isolates the drive motor that displaces roller 4 and which increases the loop 6 size by the upward movement of the lower roller 4.

The gap between the roller 2 and 5 is set to the appropriate clearance depending on the thickness of the batt being fed in. Typically the gap may be from 5 to 30 mm, preferably 18 mm. It is essential that the counter-directional movement of the belt 1 in this region does not slough back the batt and cause irregularities to be introduced into the structure.

When the batt is completely fed into the loop 6, roll 4 is raised by a small amount (typically 3 to 15 mm for a final outside diameter of 50 to 175 mm). The start and finish of this raising operation coincides simultaneously with the pre-determined post rolling period (1 to 4 minutes). During this operation the rollers 2 to 5 are rotating at constant velocity. This post-rolling operation increases fractionally the size of the loop 6 so allowing the fibres to expand and occupy this additional space. Consequently built-in stress and strain patterns within the matrix are re-distributed so ensuring a fully uniform cylinder 30. An additional advantageous contribution is the blurring of the inter faces between successive layers of batt within the cylinder 30 derived from the re-distribution of fibres and a slight felting action which takes place between these batt layers.

The formed cylinder 30 may finally be encased in a protective constraining sheath (not shown), e.g., of paper, which is fed into the loop 6 in the same manner as the batt. Alternatively the outer layer of fibres of the cylinder 30 are bonded to provide the cylinder with a protective layer by blowing hot air into the gap between the rollers 2, 5 as the cylinder 30 is slowly rotated. The cylinder can then be removed from the apparatus after movement of the rollers 5 away from roll 2 by a distance slightly greater than the cylinder 30 diameter.

The cylinder 30 of wet fibre has to be bonded into a stable structure. This is accomplished by placing the cylinder 30 on its mandrel into an oven through which hot air is blown evenly along the length of the cylinder 30 and at the appropriate temperature. With Bondalane A or Sulpholane and a cylinder of 75 mm outside diameter, 25 mm inside diameter, the cylinder 30 is heated at 120° to 130° C. for up to 90 minutes. The cylinder 30 is rotated in the oven to prevent any "set" of the synthetic fibres or gravitational distortion occurring in the cross-section. If the cylinder 30 is relatively long, it may additionally be supported on a slotted or perforated metal core which frictionally engages in, or is mechanically engaged with, the cylinder mandrel 12, and prevents longitudinal sag of the cylinder 30 element between its ends. It is essential that an oven with total hot air exchange is employed to ensure the removal from the fibrous matrix of all latent solvent vapour. After a short time in the oven, approximately 2 minutes, the outside fibres of the cylinder 30 are bonded sufficiently to permit the removal of the constraining sheath if provided. The sheath is removed to ensure the maximum passage of hot air through the fibrous matrix and hence the removal of evaporated water, or latent solvent, it further advantageously leads to a substantially equal heating history of all individual fibre bonds within the cylinder 30.

The bonds formed between the carbonisable fibres are substantially retained after carbonisation and graphitisation.

The uniformity of power generation in the final electrically conducting element as well as resistivity is influenced considerably by the care with which the latent solvent is applied, the web or batt is initially formed and the cylinder 30 wound.

The process required to convert the acrylic fibre cylinder 30 into carbon comprises a first preoxidation stage (heating the cylinder in air or oxygen) and a second heating stage in which the environment is inert.

The preoxidation stage is necessary to initiated cyclisation and aromatisation reactions and is detailed in the literature. These reactions involve the loss of H. N. O. etc. and are exothermic overall so that the heating rate is critical, generally being the maximum permitted that will allow the heat generated to be dissipated to the environment. Too rapid a heating rate accelerates the reaction and the cylinder burns. The rate is determined principally by the cylinder wall thickness, the density of the fibrous structure and the fibre type.

In order to obtain the optimum properties from the carbon fibres in the structure, preoxidation must be complete. The process is diffusion controlled and so depends markedly on fibre diameter (denier). The dwell time at the maximum temperature is determined by the denier, and the time for complete preoxidation may be calculated on this basis or measured indirectly by observing the shrinkage of the material.

The preoxidation stage comprises heating the cylinder 12 in air or oxygen to 140°-300° C. (preferably 170°-200° C.) with a rate of temperature rise of 0.001°-10° C. $min^{-1}$ (preferably 0.01°-1.0° C./min) and maintaining the maximum temperature for 24-100 hours before cooling to ambient temperature.

An acceptable range of density of the caronisable fibrous cylinders 30 is 10-250 $Kg/m^3$ (preferably 40-100 for a cylinder of 30-300 mm (preferably 75-200) O.D., 10-100 mm I.D. (preferably 25-50 I.D.) and up to 10 m long. Long cylinders 30 may be cut into shorter lengths for subsequent treatment.

The rate of temperature rise, the maximum temperature, and the dwell time at the maximum temperature, needs to be carefully selected in relation to the size and density of the fibrous cylinder 30. The fully preoxidised fibre cylinder 30 is black and brittle, the fibres being weak.

The second stage of the carbonisation process may be carried out by heating the preoxidised fibre cylinder 30 to 700° to 3000° C. preferably 900°-1200° C.) at approximately 0.5° to 35° C./min (preferably 1°-10° C./min) in an oxygen free atmosphere, for example nitrogen or argon.

The final electrical resistance of the fibrous material in the cylinder 30 is determined largely by the maximum temperature to which it has been heated. Heating to temperatures above 1500° C. in an inert atmosphere partially or completely converts the carbon to a mere graphitic form, reducing the resistivity of the material, rendering it less susceptible to damage but increasing its stiffness. The carbonisation process results in a change in geometry and density because the fibrous element shrinks and loses weight. For example the geometry range in the carbon cylinder may be 50 to 135 mm O.D., 5 to 10 mm I.D. and up to 250 cm long (the upper limit is imposed by furnace size) with a density of up to 400 $Kg/m^3$, when prepared from a precursor cylinder 30 of geometry given earlier.

While PAN fibres are preferred, other synthetic carbonisable fibres, such as synthetics of the cellulosic class such as rayon, and natural fibres, such as wool and cotton, could be used as precursor materials provided an appropriate latent solvent is used with minor alterations of the time and temperatures of the various stages of the heat treatments described above.

Instead of rolling the batt onto a mandrel as described above, other methods of making a cylindrical body could be used. For example chopped carbonisable fibres may be suspended in a liquid carrier in a vessel through which a hollow rigid fluid permeable mandrel passes. By applying suction to the interior of the mandrel the fibres are retained on the mandrel to produce a hollow cylinder of fibres which can be carbonised, after bonding of the fibres.

While the element described above is annular, it will be appreciated that the element may have other forms, such as that of a flat disc through which fluid is intended to flow from one side to the other.

To enable connection of the above described elements to a power supply, electrodes are applied to the carbonised body, for example as described in British Pat. No. 1,182,421. The element may also be associated with a fluid flow control means as described in British Pat. No. 1,466,240.

By way of example only, a method of manufacturing a permeable carbon heater element to a particular specification will now be described with reference to the flow sheet of FIG. 2. The specification is that which is required of a permeable heater element in a particular fluid heating system in which the heat generation rate, fluid temperature at the exit from the element, fluid flow rate and type of fluid are determined by the fluid heating system design, and the element geometry is determined by the fluid flow rate, fluid viscosity together with the element material density, resistivity and the power supply voltage which is specified.

Figure 2:
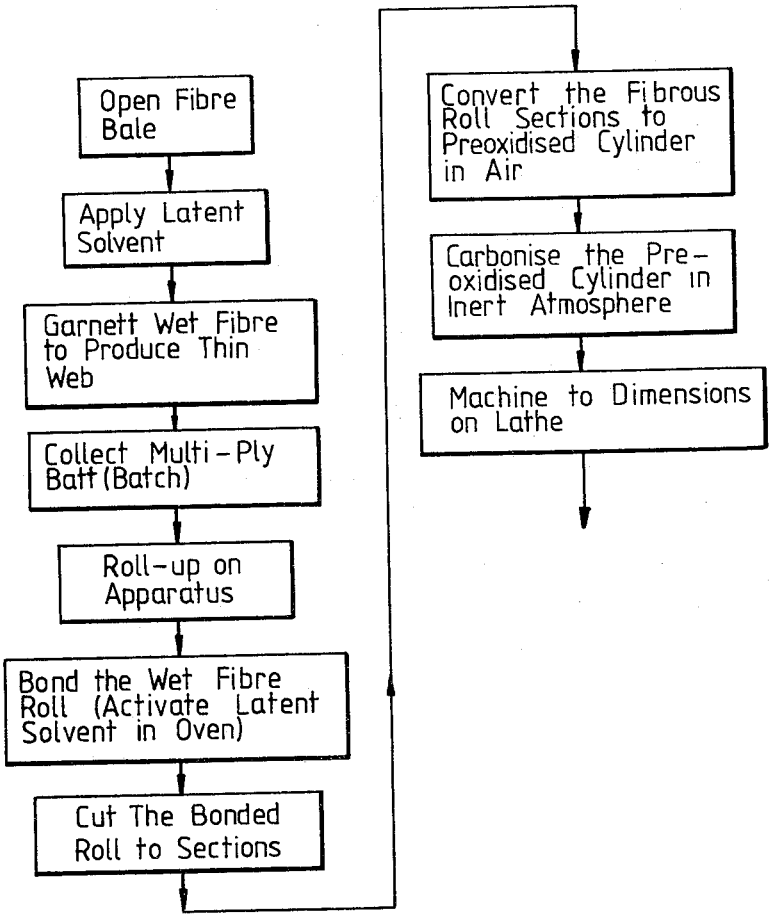
FIG. 2 shows a flow sheet of a method of manufacturing a permeable carbon heater element.
Figure 3:
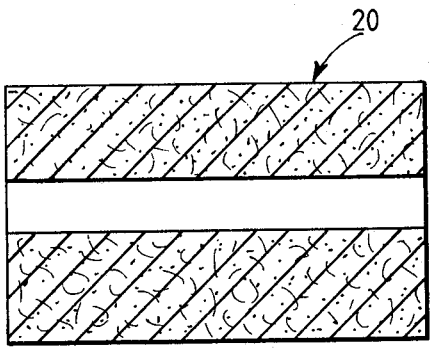
FIG. 3 shows a permeable carbon heater element made by the method described in the flow sheet of FIG. 2.

As shown in FIG. 2, to raw or blended fibers, a latent solvent is applied, and the wet fibers subsequently formed into a thin web on a typical garnett machine, the thin web then being platted or cross-folded into a multiply batt. This batt is rolled into a hollow cylinder on a mandrel as described in relation to FIG. 1 and in British Pat. No. 1,503,644, and the outer layer of fibers in the hollow cylinder is bonded by hot air, whereupon the cylinder is removed from the mandrel and placed in an oven through which hot air is blown to activate the latent solvent on the fibers and thus form fiber bonds at the contact points of the fibers. The hollow cylinder is cut into shorter sections which are preoxidised in air and subsequently carbonised in an inert atmosphere. Finally, each carbonised hollow cylinder section is machined to the required size to produce, as shown in FIG. 3, a fluid permeable electrical resistance heater element 20.

EXAMPLE

It is required to manufacture a carbon permeable heating element having the following specification:

| | |
|---|---|
| Element resistivity | 0.105–0.155 ohm cm |
| Heat generation rate: | 2.0/3kW at 10–30 volts |
| Element geometry: | Annular cylinder |
| Element inside diameter: | 20–25 mm |
| Element outside diameter: | 35–45 mm |
| Element length: | 110–130 mm |
| Fluid temperature uniformity | |
| Tmax/Tmin ratio | 1.3 |
| Element density | 110–120 kg/m$^3$ |

The method of manufacturing the heater element follows the procedure which has previously been described in relation to FIG. 2. A precursor cylinder of carbonisable latent solvent bonded fibres is fabricated by rolling up a fibre batt prepared using normal textile machinery into a cylinder by means of an endless belt machine of the type shown in FIG. 1 and described in British Pat. No. 1,503,644. After the cylinder is formed the latent solvent is activated and the fibre to fibre bonds formed at the contact points. The precursor cylinder is pre-oxidised/carbonised and the resulting carbon cylinder machined to size.

Details of the precursor cylinder formation process parameters are as follows.

Fibre: 4½ denier, 63 mm staple Courtelle-Courtauld's acrylic (PAN) latent solvent bondable fibre.

Latent solvent: Bondalaine 'A' Cyclic Tetramethylene Sulphone from Shell Chemicals—SG 1.26. The latent solvent is added to the fibres before formation of the web. The weight of the wet web from the doffer is 15 gms/m$^2$.

Batt formation:

A wet batt consisting of 5 layers is prepared from the web. The batt is approximately 12 mm in height, 1.52 M wide and is cut to 5.4 M in length and weigh 500 grams. The weight of the wet web from the doffer is 15 gms/M$^2$.

In forming the web the dry fibre weight throughput is 237 gm/minute and the latent solvent is added to the fibres before web formation at the rate of 63 gm/minute (27% add-on).

The 5.4 M of batt is fed into the endless belt rolling machine onto a mandrel 1.77 M long and 27 mm in diameter. The speed of the winding belt is 2.42 M/second at the start of the rolling process and 7.26 M/second at the finish. A post rolling period of 60–100 seconds is used after feed in is completed. The bottom roller is raised 6 mm during this post rolling process and the top roller gap is 18 mm constant.

The cylinder is then air dried to form the fibre to fibre bonds for a period of 90 minutes at a temperature of 125° C.±3° C. and rotated at a speed of 12 RPM during drying. The final weight of the bonded fibrous cylinder is 308 grams, the diameter is 72 mm and the length is 1250 mm. Density is 72 Kg/m$^3$.

The cylinder is then cut into shorter lengths which are pre-oxidised and carbonised at a temperature of 1000°–1200° C. The resulting carbon cylinders have a density of 103–101 Kg/m$^3$ for a carbonisation temperature of 1000°–1200° C. An annular carbon element is then machined from this body. The performance specification of the element is typically as follows:

| Carbonisation temperature °C. | 1000 | 1200 |
|---|---|---|
| Element outside diameter: mm | 40 | 40 |
| Element inside diameter: mm | 24 | 24 |
| Element length:mm | 120/120 | |
| Tmax/Tmin ratio: | 1.18 | 1.15 |
| Element Resistivity ohm cm | 0.154 | 0.110 |
| Element Density kg/m$^3$ | 114 | 108 |

The use of a latent solvent to provide the bonds between the fibres has the primary advantage that it allows the matrix of carbonisable fibres to be formed into the desired geometry and density before any fibre to fibre bonds are formed and fibres rigidly located relative to each other. Thus a more uniform structure can be obtained and reproducibility of structure geometry from one matrix to another is considerably improved. Once the desired matrix geometry and density is attained the bonding is effected by activating the solvent and the desired matrix geometry and density is retained by means of the bonds formed. Since activation is by temperature only there is no resin impregnation stage to introduce non-uniformity of density, the final carbonised structure will have.

We claim:

1. A method of manufacturing a fluid permeable electrical resistance heater element comprising the steps of forming a fluid permeable body of carbonisable fibres, applying to the fibres a latent solvent for the fibres, activating the solvent to dissolve the surfaces of the fibres and thereby fuse touching fibres together, and carbonising the body of bonded fibres.

2. A method according to claim 1, wherein the solvent is applied to the carbonisable fibres prior to forming them into the fluid permeable body, and the solvent is activated after the fluid permeable body is formed.

3. A method according to claim 1, wherein the solvent is applied to the carbonisable fibres after forming them into the fluid permeable body and the solvent is activated before the body is carbonised.

4. A method according to claim 1, wherein the latent solvent is applied in part before and in part after the fibres are formed into the body.

5. A method according to claim 1 comprising the steps of: producing carbonisable fibres which have a diameter of 3 to 200 microns and staple lengths in the range of 1 to 250 mm; forming the fibres into a fluid permeable body having a mean density of 10 to 250 $Kg/m^3$ and a voidage in the range of 75 to 99%; applying to the fibres a latent solvent for the fibres; activating the solvent thereby to effect bonding of the carbonisable fibres together; heating the body in an oxidising environment to a temperature of 140° to 300° C. at the rate of temperature rise of between 0.001 to 10% per minute to produce an oxidised body having a density in the range of 15 to 400 $Kg/m^3$; and heating the oxidised body to a temperature of 700° to 3000° C. at the rate of temperature rise of 0.5° to 50° C. per minute in a substantially oxygen free environment to produce a carbonised body having a density up to 400 $Kg/m^3$ and a voidage in the range 75 to 98%.

6. A method according to claim 1 wherein the step of forming the fibres into a fluid permeable body comprises the steps of forming a bulky uncompacted batt of fibres which has a weight per unit area of 10 to 500 $g/m^2$ and rolling the batt onto a mandrel in a tensionless manner in a rolling machine while controlling the mean bulk density of the rolled body by controlling the rolling conditions applied to the batt.

7. A method according to claim 1, wherein the fibres are polyacrylonitrile fibres or copolymers thereof and the latent solvent is a cyclic tetramethylene sulphone which is thermally activated by heating the fibres in air to a temperature of 110° C. to 150° C.

8. A method according to claim 1, wherein the latent solvent is propylene carbonate.

9. A method according to claim 1, wherein the latent solvent is a di-substituted formamide.

10. A method according to claim 8, wherein the latent solvent is bis-cyanoethyl formamide.

11. A method according to claim 6, wherein the rolling conditions are controlled to provide a uniform radial and circumferential density of rolled body prior to effecting bonding of the fibres.

12. A fluid permeable electrical resistance heater when made according to the method claimed in any one of claims 1 to 11.

13. A fluid permeable electrical resistance heater element comprising an assembly of carbonised fibres in a random disposition wherein fibre to fibre joining at the points of contact of the fibres is effected before carbonisation of the fibres, the joining being effected by fusing touching fibres together by applying a latent solvent, which is latent during the process by which the shape, density, and final structure of the element are largely determined, and actuating the solvent prior to carbonising the fibres to dissolve the surfaces of the fibres and thereby fuse touching fibres together.

14. A fluid permeable electrical resistance heater element as claimed in claim 13, in which the assembly of carbonised fibres is the product of carbonising or carbonising and graphitising, a similar assembly of carbonisable synthetic fibres which are bonded together by means of a latent solvent which is temperature activated.

15. A fluid permeable electrical resistance heater element as claimed in claim 14, wherein the latent solvent dissolves the surface of the fibres, when temperature activated, and forms a bond between touching fibres utilising the fibre material itself such that the bonded structure consists largely of fibre material only.

* * * * *